US006681613B1

(12) United States Patent
English

(10) Patent No.: US 6,681,613 B1
(45) Date of Patent: Jan. 27, 2004

(54) CHIMNEY FLASHING FABRICATION TOOL

(76) Inventor: Jody English, 138 Rook St., Battle Creek, MI (US) 49014

( * ) Notice: Subject to any disclaimer, the term of this patent is extended or adjusted under 35 U.S.C. 154(b) by 0 days.

(21) Appl. No.: 10/372,542

(22) Filed: Feb. 24, 2003

(51) Int. Cl.[7] ..... B21D 5/16; B21D 11/20
(52) U.S. Cl. ..... 72/457; 72/319; 72/477
(58) Field of Search ..... 72/319, 320, 321, 72/457, 458, 477, 478, 479

(56) References Cited

U.S. PATENT DOCUMENTS 3,352,466 A * 11/1967 McAllister
3,848,454 A * 11/1974 Hall ..... 72/457
4,191,043 A * 3/1980 Schaffer ..... 72/319
5,024,076 A 6/1991 Warner ..... 72/211
5,199,294 A 4/1993 Murczek ..... 72/457
5,715,722 A 2/1998 Morley ..... 72/319
5,836,198 A 11/1998 Guilford ..... 72/458

* cited by examiner

*Primary Examiner*—David B. Jones
(74) *Attorney, Agent, or Firm*—Sturm & Fix LLP

(57) ABSTRACT

A fabrication tool (10) for fabricating flashing (200) that surrounds a chimney (100) wherein, the fabrication tool (10) comprises an elongated rectangular base plate member (20) and an elongated rectangular top plate member (40) having a longitudinal stamped recess (42) that is laterally offset from the longitudinal axis of the top plate member (40) wherein, the bottom surface of the recess is permanently affixed to the base plate member (20) to define different depth bending slots (51) (52) to bend strips of sheet metal flashing (200) into a desired configuration.

9 Claims, 2 Drawing Sheets

Fig. 4
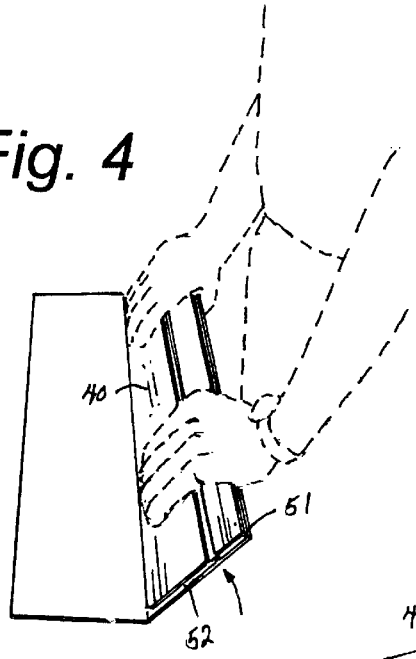
Fig. 5
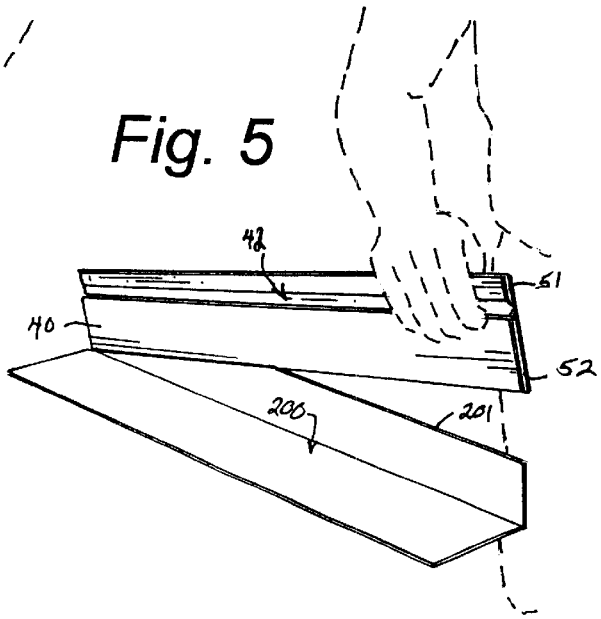
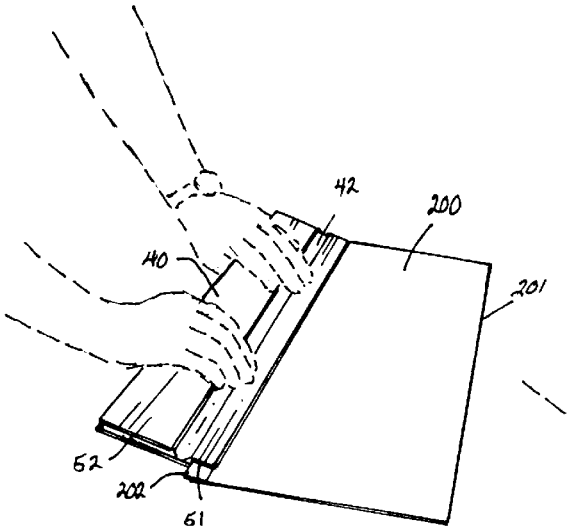
Fig. 6
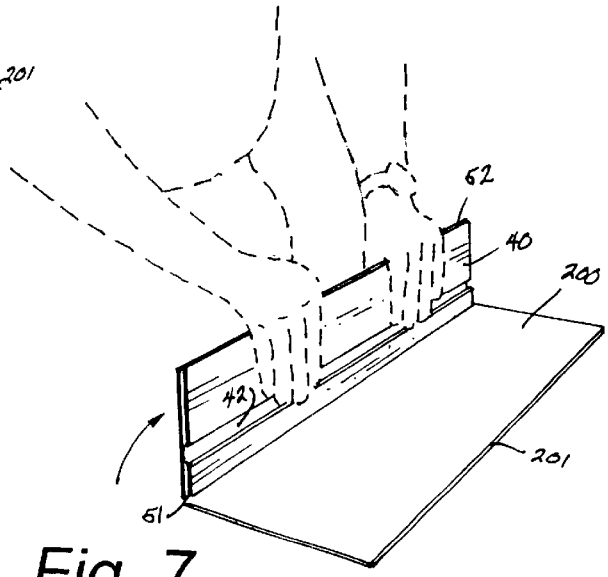
Fig. 7

CHIMNEY FLASHING FABRICATION TOOL

BACKGROUND OF THE INVENTION

CROSS REFERENCE TO RELATED APPLICATIONS

Not applicable.

1. Field of the Invention

The present invention relates to the field of sheet metal bending tools in general and in particular to a one step chimney flashing fabrication tool.

2. Description of Related Art

As can be seen by reference to the following U.S. Pat. Nos. 5,199,294; 5,836,198; 5,715,722; 5,024,076; 3,583,199, the prior art is replete with myriad and diverse sheet metal bending tools.

While all of the aforementioned prior art constructions are more than adequate for the basic purpose and function for which they have been specifically designed, they are uniformly deficient with respect to their failure to provide a simple, efficient, and practical sheet metal bending tool that is specifically designed for the purpose of fabricating flashing strips for chimneys.

As anyone in the building trades is well aware, when a residence is equipped with a functional chimney, all building codes require that an exterior sheet metal flashing be installed around the periphery of the chimney at the juncture of the chimney with the roof line.

As a consequence of the foregoing situation, there has existed a longstanding need in the building trades for a new and improved sheet metal bending tool that is specifically designed to quickly and easily form contoured flashing strips in a one step operation that can be performed on the roof adjacent to the chimney, and the provision of such a device is the stated objective of the present invention.

BRIEF SUMMARY OF THE INVENTION

Briefly stated, the flashing fabrication tool that forms the basis of the present invention comprises in general a base plate member and a top plate member wherein, a stamped recess is formed in the top plate member and the bottom of the stamped recess is fixedly connected to the top of the base plate member.

As will be explained in greater detail further on in the specification, the stamped recess is offset in a parallel relationship to the longitudinal axis of the top plate member to form two different depth bending slots wherein, the depth of the stamped recess defines the width of each of the bending slots.

Furthermore, the width of the stamped recess creates a stiffening rib for the top plate member relative to the base plate member to maintain the width of the openings on the outboard ends of the fabrication tool when subjected to the bending of pre-cut strips of sheet metal to fabricate flashing strips for the periphery of chimney stacks on a roof line of a house or the like.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 4 shows the fabrication tool initiating a deep bend;

FIG. 5 shows the completion of the deep bend;

FIG. 6 shows the fabrication tool initiating a shallow bend; and,

FIG. 7 shows the completion of the shallow bend.

DETAILED DESCRIPTION OF THE INVENTION

Figure 1:
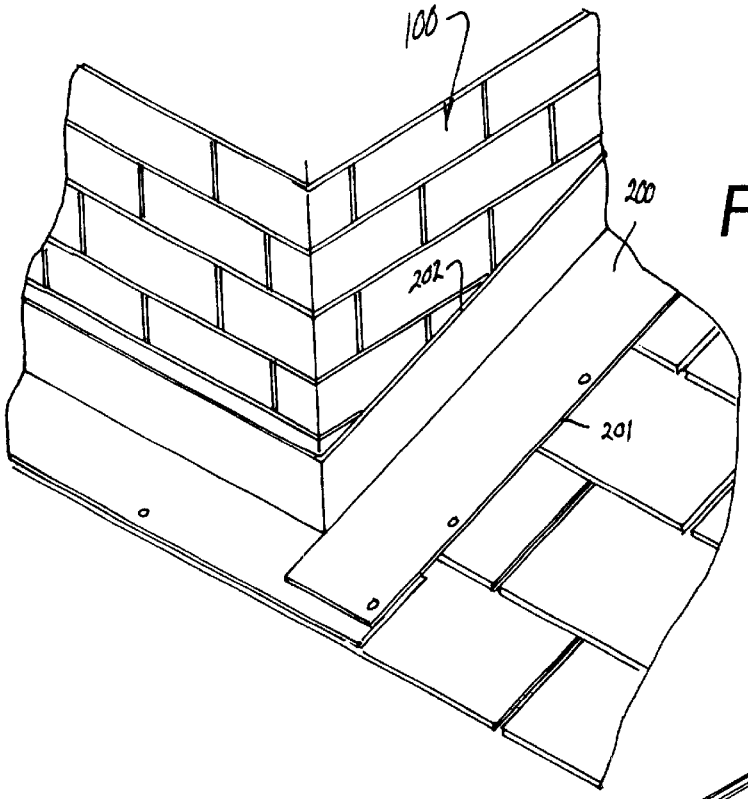
FIG. 1 is a perspective view showing a chimney equipped with flashing fabricated by the fabrication tool of this invention.
Figure 2:
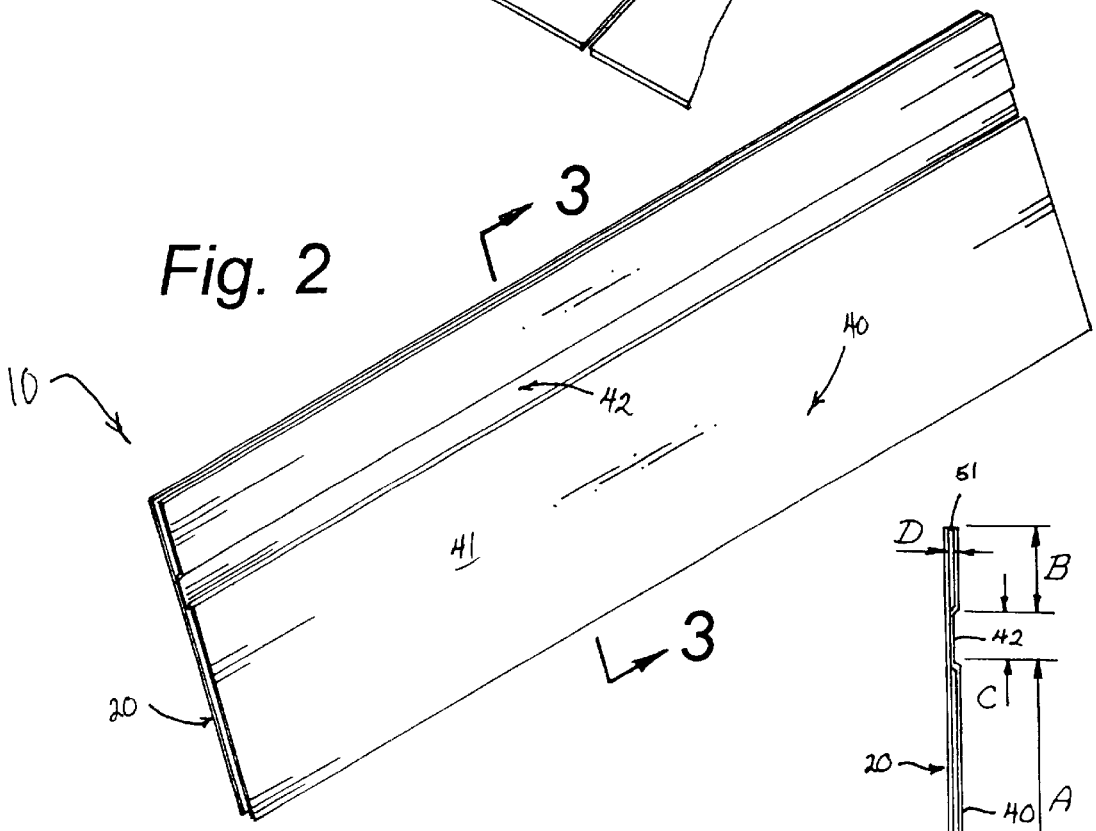
FIG. 2 is a perspective view of the flashing fabrication tool.

As can be seen by reference to the drawings, and in particular to FIG. 2, the flashing fabrication tool that forms the basis of the present invention is designated generally by the reference number 10. The fabrication tool 10 comprises in general an elongated rectangular base plate member 20, an elongated rectangular top plate member 40, and connector means 30 for joining the top plate member 40 to the base plate member 20.

Figure 3:
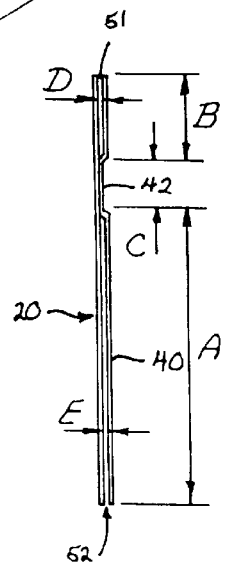
FIG. 3 is a cross-sectional view taken through line 3—3 of FIG. 2.

As shown in FIGS. 2 and 3, both the base plate member 20 and the top plate member 40 have a length in excess of 30" and preferably at least 32" so that the length of the fabrication tool 10 is greater than the width of the standard 20" and 30" square chimney flues 100; and, a width of at least 4" for reasons that will be explained in greater detail further on in the specification.

In addition, the base plate member 20 comprises a rigid flat steel plate 21 having a thickness of between * and * of an inch and the top plate member 40 starts off as a mirror image flat steel plate 41 which is further provided with an elongated longitudinal stamped recess 42 which is offset from the longitudinal axis of the top plate member 40 for reasons that will be explained presently.

Still referring to FIGS. 2 and 3, it can be seen that the bottom of the stamped recess 42 is fixedly connected to the top of the base plate member 20 by either spot welding or space age adhesives to create two narrow slotted bending chambers 51 52 wherein, the depth of the recess 42 defines the width of the bending chamber openings and the stamped recess 42 forms a stiffening spine to prevent the flexure of the top plate member 40 relative to the base plate member 20.

Furthermore, it can also be seen that the bending chambers 51 52 comprise a truncated depth counter flashing bend chamber 51 and an elongated depth flashing bend chamber 52 wherein, in the preferred embodiment of the invention, the depth of the counter flashing bend chamber 51 has a depth of ½" and the flashing bend chamber 52 has a depth of 3".

Turning now to FIGS. 4 through 7, it can be seen that the flashing fabrication tool 10 is employed in conjunction with a pre-cut strip of sheet metal 200 whereby, one elongated edge 201 of the strip of sheet metal 200 is inserted into the flashing bend chamber 52 to form the horizontal portion of a chimney flashing, and the other elongated edge 202 of the strip of sheet metal 200 is inserted into the counter flashing bend chamber 52 to form the vertical portion of a chimney flashing.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A chimney flashing fabrication tool comprising an elongated rectangular base plate member an elongated rectangular top plate member; and, means for joining the top plate member to the base plate member to form first and second bending slots having uniform width openings wherein, the depth of the first bending slot is at least twice the depth of the second bending slot; wherein, said top plate member is provided with a longitudinal stamped recess that is parallel to and offset from the longitudinal axis of the top plate member.

2. The fabrication tool as in claim 1; wherein, the length of the base plate member and the top plate member is at least 20".

3. The fabrication tool as in claim 1; wherein, the length of the base plate member and the top plate member is at least 30".

4. The fabrication tool as in claim 2; wherein, the width of the base plate member and the top plate member is at least 4".

5. The fabrication tool as in claim 3; wherein, the width of the base plate member and the top plate member is at least 4".

6. The fabrication tool as in claim 1; wherein, the base plate member has a top surface and the stamped recess of the top plate member has a bottom surface which is fixedly connected to the top surface of the base plate member.

7. The fabrication tool as in claim 6; wherein, the fixed connection is formed by spot welding.

8. The fabrication tool as in claim 6; wherein, the fixed connection is formed by space age adhesives.

9. The fabrication tool as in claim 1; wherein, the depth of the stamped recess is equal to the width of the bending slot openings.

* * * * *